US005443185A

United States Patent [19]

Fuchs

[11] Patent Number: 5,443,185

[45] Date of Patent: Aug. 22, 1995

[54] DISPENSER FOR MEDIA

[75] Inventor: Karl H. Fuchs, Radolfzell, Germany

[73] Assignee: Ing. Erich Pfeiffer GmbH & Co. K.G., Germany

[21] Appl. No.: 151,480

[22] Filed: Nov. 12, 1993

Related U.S. Application Data

[63] Continuation of Ser. No. 788,486, Nov. 6, 1991, abandoned.

[30] Foreign Application Priority Data

Nov. 9, 1990 [DE] Germany ..... 40 35 688.4

[51] Int. Cl.[6] ..... B05B 9/043

[52] U.S. Cl. ..... 222/321.8; 222/383.3; 239/333

[58] Field of Search ..... 222/631, 321, 385, 383; 239/333

[56] References Cited

U.S. PATENT DOCUMENTS

| | | | |
|---|---|---|---|
| 4,051,983 | 10/1977 | Anderson | 222/321 |
| 4,189,064 | 2/1980 | O'Neill et al. | 222/321 |
| 4,262,823 | 4/1981 | Monden | 222/321 |
| 4,274,560 | 6/1981 | Cater . | |
| 4,964,547 | 10/1990 | Lina | 222/385 |
| 5,011,046 | 4/1991 | Graf et al. | 222/385 |
| 5,020,696 | 6/1991 | Cater | 222/385 X |
| 5,096,097 | 3/1992 | Lina | 222/385 |
| 5,110,052 | 5/1992 | Graf et al. | 239/333 |

FOREIGN PATENT DOCUMENTS

| | | | |
|---|---|---|---|
| 0004127 | 9/1979 | European Pat. Off. | 239/333 |
| 0289855 | 11/1988 | European Pat. Off. | 222/385 |
| 0345132 | 12/1989 | European Pat. Off. | 222/385 |
| 2407752 | 6/1979 | France . | |
| 2645835 | 10/1990 | France | 222/321 |
| 3544985 | 6/1987 | Germany . | |
| 3715301 | 11/1988 | Germany . | |
| 3722469 | 1/1989 | Germany . | |
| 2023225 | 12/1979 | United Kingdom . | |

*Primary Examiner*—Andres Kashnikow
*Assistant Examiner*—Kenneth Bomberg
*Attorney, Agent, or Firm*—Quarles & Brady

[57] ABSTRACT

A discharge apparatus for media has a medium pump and a compressed air pump, as well as control means through which, in stroke-dependent manner, precompression only takes place in the air pump during a first partial stroke and then during a further partial stroke delivery takes place from both pumps following a pressure-dependent opening of the delivery valve and finally during a further partial stroke delivery only takes place from the air pump. In order that the medium pump does not deliver to the outlet channel over intermediate and final partial strokes, delivery takes place back into the reservoir via the inlet channel.

28 Claims, 3 Drawing Sheets

DISPENSER FOR MEDIA

This is a continuation of application Ser. No. 788,486, filed Nov. 6, 1991, (now abandoned).

BACKGROUND OF THE INVENTION

The invention relates to a discharge apparatus for at least one medium or for flowable media having substantially random aggregate states. Such a discharge apparatus can admittedly be operated for the discharge of at least one medium via a pressure source, e.g. a pressure reservoir, and is consequently operated merely by the manual opening of a delivery valve, but appropriately, for at least one medium, has a pump with a pump chamber, which is constricted by manual force for delivering the medium.

The delivery of at least one medium can be controlled in stroke-dependent manner for various purposes. For example, a delivery valve can be stop-opened at the end of the stroke in order to obtain a high discharge pressure. It is also possible at the end of the stroke, e.g. by raising the seal or packing of a piston pump, to provide a pressure relief, so that delivery of the medium is ended suddenly. Moreover, control means are conceivable, in order to deliver a further medium, e.g. pressurized gas in addition to the first medium, before the start or after the end of the delivery of said first medium through the discharge opening, or in order to discharge with a time lag the first or a further medium only following a partial stroke following the start of the stroke.

It is also possible to provide control means in order to deliver at least part of the further medium directly to a discharge nozzle or at least one part at a greater distance before the same directly into an outlet channel leading to the discharge opening or to the discharge nozzle. Thus, the media can be mixed at a random point or for a cleaning of the outlet channel and the nozzle or for other purposes, each medium can be successively delivered. As a function of the characteristics of the medium or the nature of the discharge, numerous effects can be obtained, but there is a need to allow still further effects and actions. Preferably the dispenser is operable in hand-held manner and to be actuated single-handed only by manual force.

OBJECT OF THE INVENTION

An object of the invention is to provide a dispenser capable of avoiding disadvantages of known construction or to achieve effects of the described kind. Another object is to ensure a very precise control of medium delivery with respect to at least one medium. A further object is to provide a simple construction of the dispenser.

SUMMARY OF THE INVENTION

According to the invention, instead of determining the start of medium delivery following a first partial stroke only by opening a delivery valve, controls said start or build up of the discharge pressure in such a way that delivery only takes place after a first partial stroke. The medium delivery can then be interrupted one or more times, by relieving the discharge pressure in the pump chamber. The idle path of the operating stroke corresponding to the first partial stroke up to the response of the mechanically operating control means can be utilized for numerous different functions.

This idle path can be used for the build up of a delivery pressure of a second medium or for opening a pressure-dependent operating delivery valve for said second medium. As a result, compressed air can be initially pretensioned during the idle path in an air pump chamber and can then be predelivered by opening its delivery valve, and only then is the first liquid medium delivered to the discharge opening. The delivery of the air can then take place continuously up to the end of the operating stroke and optionally for a short time beyond this, while the delivery of the first liquid medium is stopped prior to the end of the stroke. As a result of the mechanical control means, a very precise reciprocal adjustment of these functional sequences is possible.

When using a pump, the pressure in the pump chamber is appropriately modified by opening and closing a slide controlled control valve between a discharge pressure adequate for the discharge to the discharge opening and a pressure not adequate for this purpose. The valve outlet of said at least control valve does not lead to the outlet channel or opening, but via a return channel back into a medium reservoir. No separate return channel is required for this if the inlet or suction channel for the pressure chamber is simultaneously used as the return channel. In addition, no separate control valve is required, if the latter is formed by a controlled intake valve for the pressure chamber, for which it is then not necessary to have an intake valve, such as a ball valve, operating in pressure-dependent manner. No separate component is required for the movable intake valve body if same is formed by a pump piston, particularly a presuction piston of the pump. During return flow, the medium is twice diverted or substantially reversed in direction, firstly substantially in an upward direction out of the pump chamber and then oppositely downwardly into the return channel for return to the storage vessel.

The inventive construction is particularly suitable for discharge apparatus according to U.S. Pat. No. 5,011,046, to which reference should be made for further details and effects. The first idle or partial stroke is appropriately more than 1/9 to $\frac{1}{4}$ or $\frac{1}{3}$ of the overall stroke and can also be approximately $\frac{1}{2}$ of the stroke. In order to prevent the build up of an adequate discharge pressure in the pump chamber during the particular partial stroke, the corresponding piston need only be guided with its inner circumference in unsealed manner on an intake channel substantially freely projecting into the pump chamber. The inner circumference of the piston can have a corresponding ring spacing from the outer circumference of the intake channel. The latter is provided in the jacket with passage openings or can have on the outer circumference, longitudinal channels over the associated length portion. In the area over which a discharge pressure is to be produced in the pump chamber, the piston runs tightly on the outer circumference of the intake channel, which in this area has no passage openings, slots or widened collar.

The component determining the control characteristics of the control means and which can be constructed in the manner of a control cam, is preferably in the form of a part separate from an associated support part or body, so that the control characteristics can be modified at random by the choice of this component. The component can be fixed solely by a plug or snap connection or can be secured by a retaining spring. Appropriately, the control valve is substantially entirely located within the pump chamber.

The passage cross-section of the inlet channel can be varied in stroke-dependent manner. For example, after a first partial stroke in the return channel a mandrel or a part of a spring can be inserted into the inlet channel. Consequently, the inlet channel is free in the complete inside width at the start of the stroke, and following a first short partial stroke and prior to the closing of the control valve, the inlet channel is limited to a ring passage. The limited return inlet channel, which can also be helical due to the spring, then forms a return choke, so that up to the closing of the control valve, a pressure has built up in the pressure chamber, but whose level is lower than the discharge pressure required for delivery into the outlet channel.

If there is a discharge of two or more media from separate pressure chambers and optional reservoirs, then the discharge apparatus is appropriately constructed according to U.S. Pat. No. 5,110,052, to which reference should be made for further details and effects. The control means for the first, usually incompressible, medium can be so constructed that during the substantially continuous delivery of the second medium, at least one pump surge or thrust is produced with which the first medium is supplied to the second medium. As a result of the inventive construction, it is also possible to obtain a very fine atomization of a substance. The discharge of the second medium appropriately takes place through pressure-dependent opening of an associated discharge valve, so that the delivery rate of said medium does not drop below a predetermined value.

BRIEF FIGURE DESCRIPTION

These and further features can be gathered from the claims, description and drawings and the individual features can be realized singly or in the form of subcombinations in an embodiment of the invention and in other fields and can represent advantageous, independently protectable constructions for which protection is hereby claimed. An embodiment of the invention is described in greater detail hereinafter relative to the drawings, wherein show:

FIG. 1 An inventive discharge apparatus in a part sectional view.

FIG. 2 A detail of the discharge apparatus in a larger-scale form.

FIG. 3 The detail according to FIG. 2, but in the working position.

DETAILED DESCRIPTION OF A PREFERRED EXAMPLE EMBODIMENT

Figure 1:
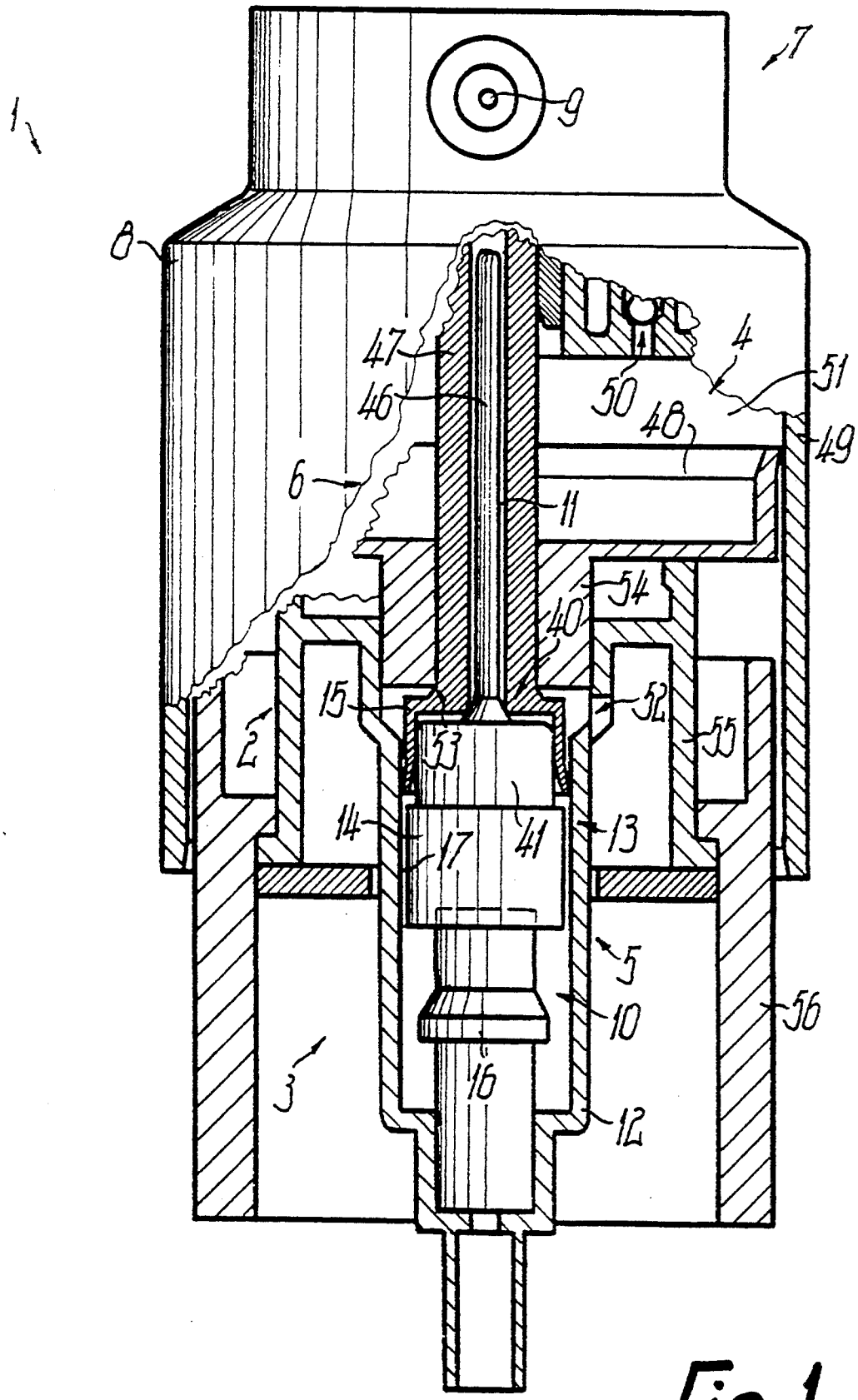

Referring to the figures, the discharge apparatus 1 essentially made from plastic injection moldings is used for tight mounting on the neck of a reservoir from which, with each return stroke of the apparatus 1, is drawn a specific quantity of a medium via a riser connected to a base of a discharge unit 3. It also has a compressed air delivery means 4, which draws air from the atmosphere, while bypassing a medium thrust piston pump 5 of the discharge unit 3. The air delivery means is essentially formed by an air thrust piston pump 6 arranged equiaxially to the medium pump 5 on a common body 2. Both pumps 5, 6 are to be so simultaneously operated with a common actuator 7 formed by a discharge and actuating head 8 using finger pressure, that a thrust actuation is transferred to the pump movement.

The actuating head 8 has a discharge opening 9 issuing into the open which, regulated by the control means 10, is connected via an outlet channel 11 to the discharge unit 3 and via a separate channel issuing closely upstream thereof to the air delivery means 4 positioned closer to it.

A cylinder casing 12 constructed in one piece with the body 2 receives a piston unit 13, which is formed by two separate, reciprocally axially movable and constantly interengaging pump pistons 14, 15 of the discharge unit 3. The pump piston 14 projects part the other pump piston 15 in the pump stroke direction roughly over half its length, and moves along a piston running path 16. The inner circumference of the cylinder casing 12 forms a cylinder running path 17 for sealed engagement of the front end of the pump piston 15 which like the pump piston 14, has a cup-shaped construction, but is significantly shorter. Between the cylinder running path 17 and the outer circumference of the lower, widened portion of the pump piston 14, an annular clearance is formed. A clearance is also formed between the inner circumference of the pump piston 15 and the outer circumference of the pump piston 14. The successive annular clearances form a flow connection for the outlet channel 11.

The cylinder casing 12 forms an inlet with the end facing the piston unit 13 on the side remote from the conveying means 4 and by means of which the medium pump 5 draws fluid through a riser from the reservoir and by means of which, regulated by the control means 10, it can be returned into the reservoir. This inlet forms part of the inlet and return channel 18, whose flow cross-section is variable in stroke-dependent manner. The channel 18 is completely located within the cylinder casing 12 and is substantially equiaxial thereto. The channel 18 is defined by a sleeve 19 substantially free and projecting equiaxially into the cylinder casing 12 and whose outer circumference has a radial spacing from the cylinder running path 17 and forms with an inner sealing lip 21 at the first end of the pump piston 14 a control valve 20. The sealing lip 22 engaging the piston running path 17 is located at the front end of the pump piston 15.

Between its ends and over only part of its length covered by the sealing lip 21, the outer circumference of the sleeve 19 forms a valve seat 23 for the sealed displaceable engagement of the lip 21. For this purpose, the sleeve 19 is provided on the associated portion with a collar 24 projecting radially forward the cylinder running path 17. Above a cylindrical valve seat 23 reached first by the sealing lip 21 during the pump stroke is formed an acute-angled, frustum-shaped sloping surface 25, while the other lower end of the seat 23 is bounced by a ring shoulder 26 approximately at right angles to the valve seat 23. The portions 27, 28 adjacent to the collar 24 can have substantially the same, constant outside width up to the associated end, in such a way that an annular clearance is defined between them and the sealing lip 21. A plug-in portion 29 formed by a front end also has the same outside width, and by it, the sleeve 19 is inserted in stop-limited manner into a closely adapted opening of the cylinder casing 12, restricted with respect to the cylinder running path 17 and connected thereto via a ring shoulder.

The piston 14 forms with the sleeve 19 a choke 20, whose flow cross-section varies with the position of the pump piston 14. The jacket of the pump piston 14 is so narrowed at a distance above the sealing lip 21 and on the inner circumference, that it can define with the outer circumference of the portion 27 a narrower annular clearance compared with that provided in the vicinity of the sealing lip 21. A mandrel 31 located entirely within the pump piston 14 also projects over the inside of the end wall of the pump piston 14 and its front end is set back relative to the sealing lip 21. On the outer circumference of the mandrel 31 is mounted in closely engaging form the end of a pretensioned helical compression spring 32, which serves as the only spring for all the restoring or return functions of the discharge unit 3 and for the pump return of the air delivery means 4. The other end of the spring 32 is supported on a ring shoulder within the plug-in portion 29 and therefore presses the sleeve 19 connected to the riser into its stop position. The spring 32 engages with its outer circumference closely on the inner circumference of the channel 18. In the initial or starting position according to FIGS. 1 and 2, the free end 33 of the sleeve 19 within the pump piston 14 is at a limited distance above the sealing lip 21 and faces with a limited spacing the front end of the mandrel 31.

Figure 2:
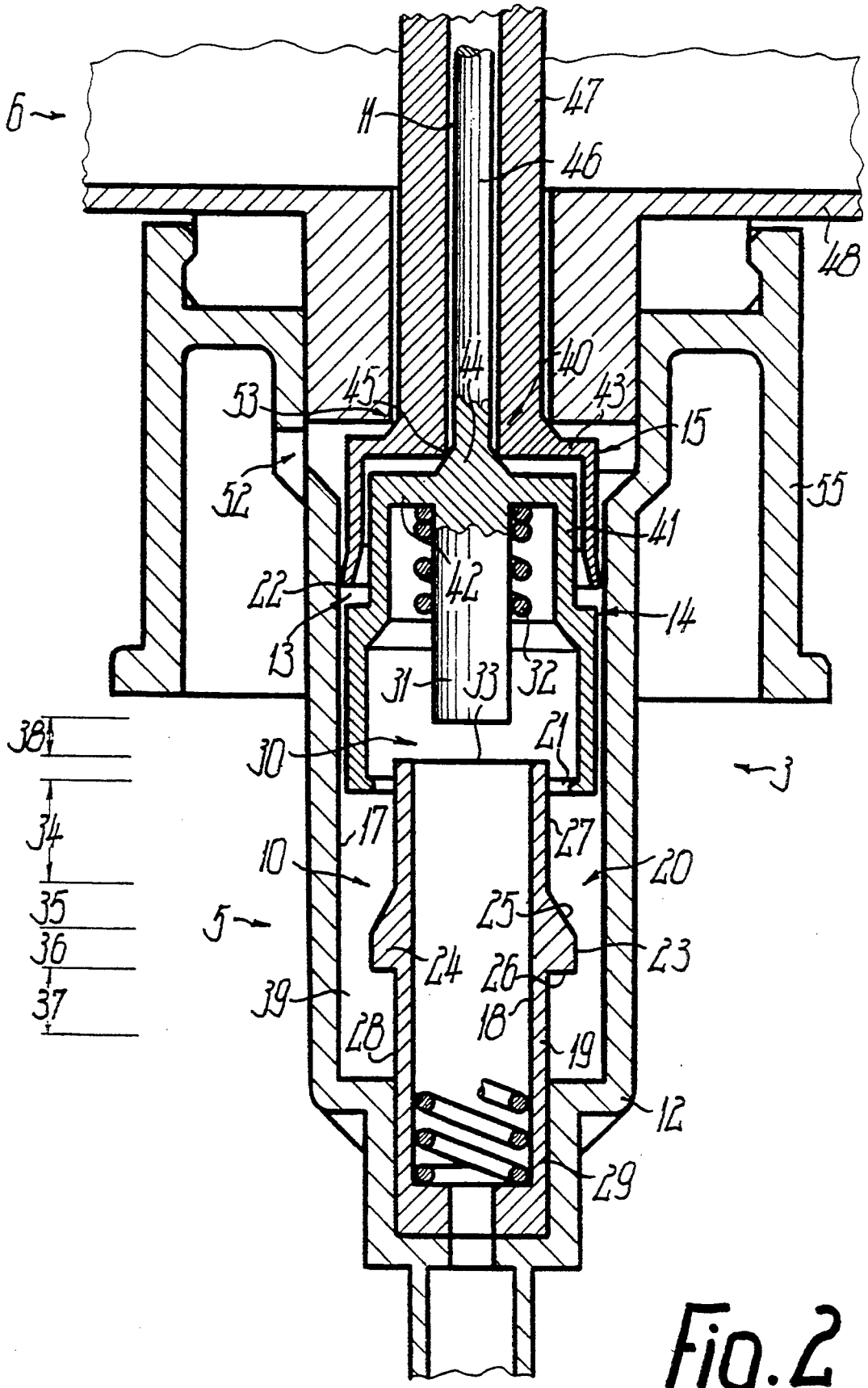
Figure 3:
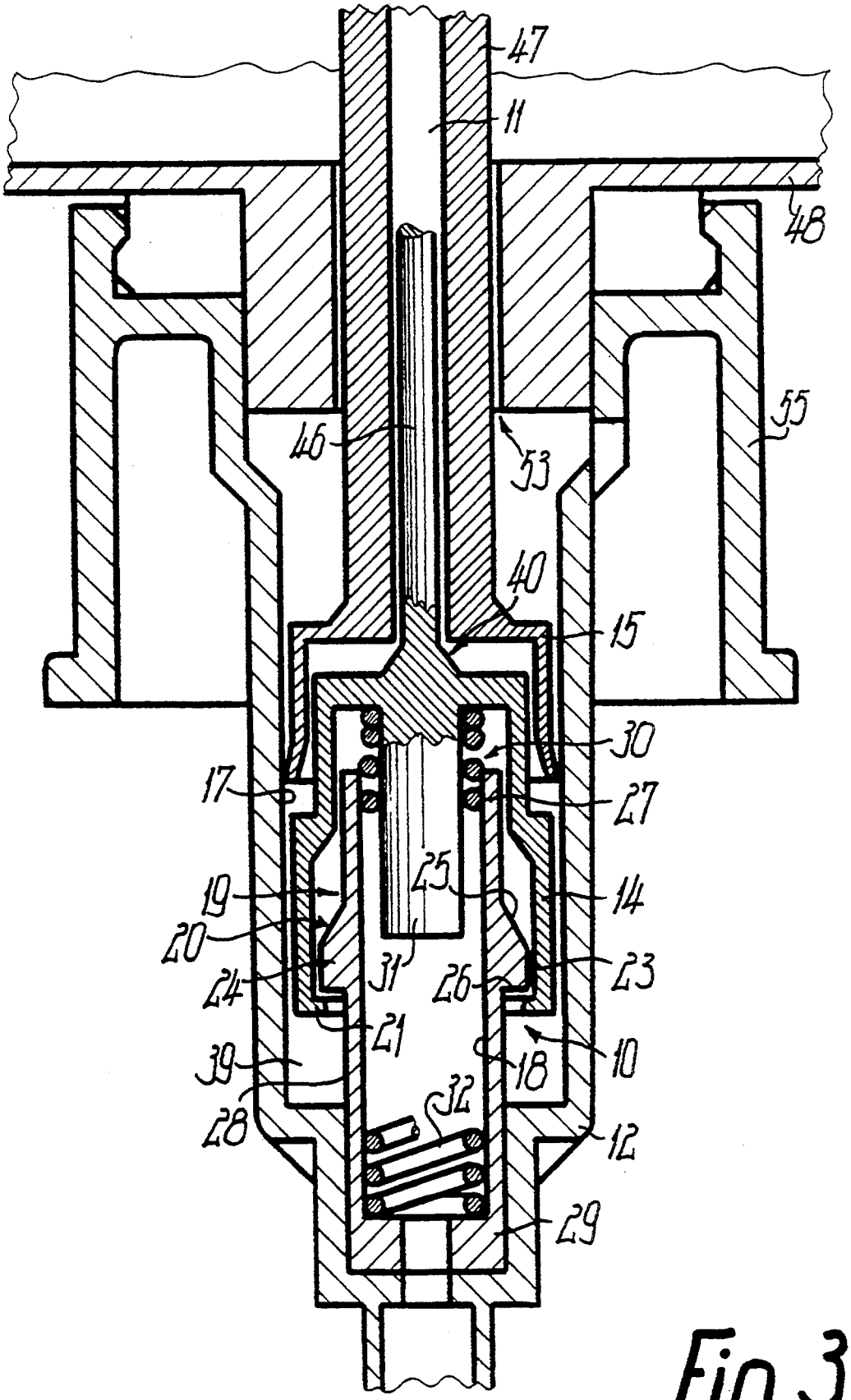

Referring to FIG. 2, if the pump piston 14 is moved over a first partial stroke 38 corresponding to said spacing, then the front end of the mandrel 31 penetrates the free end 33 and the channel 18, so that through the intermediate turns of the spring 32 within the sleeve 19 and connecting to the end 33, a helical channel is bounded substantially closed in cross-section over the outer circumference and whose flow cross-section can be smaller than that of the annular clearance in the vicinity of the sealing lip 21. The partial stroke 38 is at the beginning of a next partial stroke 34, which is required until the sealing lip 21 has reached the start of the sloping face 25. Over the next partial strike 35, the annular clearance in the vicinity of the sealing lip 21 becomes constantly narrower until the lip 21 runs up onto the sloping face 25 and consequently closes the connection between the channel 18 and the annular pump chamber 39. Roughly at the same instant or shortly thereafter, the free end 33 of the sleeve 9 enters the narrowed portion of the pump piston 14, so that both parts are guided on one another and liquid in the hollow pump piston 14 can be pressed further through the channel 18 and back into the reservoir.

Under radial pretension the sealing lip 21 now passes onto the cylindrical valve seat 23, which determines the next partial stroke 36 and over which a delivery or discharge pressure is built up in the pump chamber 39. A standard quantity level of the medium can be delivered from the pump chamber 39, via said annular clearances on the outer circumferences of the pump piston 14 to the outlet channel 11. As soon as the sealing lip 21 on the ring shoulder 26 has reached the end of the valve seat 23, as a function of the chosen dimensions, it is possible to constrict, open or close the line connection between the now substantially constricted pump chamber 29 and the channel 18.

The line connection is opened if the outer circumference of the portion 27 is smaller than the constructed inner circumference of the pump piston 14, because there is an annular passage gap. The line connection is closed if the outside width of the portion 27 is roughly the same as the constricted inner circumference. Because the valve seat 23 is connected to a right-angled or obtuse-angled, conical shoulder 26, the annular clearance between the sealing lip 21 is suddenly opened on passing over said end. The final partial stroke 37 takes place until the pump piston 14 strikes the end 33 of the sleeve 19 and the sealing lip 21 is still at a limited distance from the bottom of the pump chamber 39.

In the vicinity of the inner end of the outlet channel 11 connected to the interior of the pump piston 15, an outlet or delivery valve 40 is provided pretensioned towards the closed position by the spring 32 and whose reciprocally movable valve parts are provided on the two pump pistons 14, 15. The conical valve body 44 is constructed in one piece with the end wall 42 terminating the pump piston 14 at the constricted, cylindrical piston portion 41, and its base projects over its outside. The end 33 strikes against the outside of this end wall 42, and the spring 32 is supported. The narrow end of the valve body 44 transitions in one piece into a shaft 46 extending over most of the length of the outlet channel 11 and is mounted by insertion in a central channel of a piston tappet 47 and defines with the latter a cross-sectionally annular portion of the outlet channel 11. Thus, in the starting position, the pump piston 14 is only centered relative to the remaining pump parts by the valve body 44 and can then be guided on the corresponding partial strikes 35 to 37 by guidance on the sloping face 25, on the valve seat 23 and/or on the portion 27, so that a precise centering is also ensured when the delivery valve 40 is open.

The delivery valve 40 is adjusted in such a way that it opens against the tension of the spring 32 when the sealing lip 21 runs onto the valve seat 23, so that then the medium is delivered in a pump surge from the pump chamber 30 to the discharge opening 9. As soon as the sealing lip runs over the valve seat 23 at the end of the partial stroke 36, the pump chamber 39 is pressure-relieved by return to the channel 18, so that the opening pressure for the delivery valve 40 acting on the rear faces of the pump piston 14 suddenly drops and the valve 40 is closed again. With the valve 40 closed, the remaining partial stoke 37 is performed. On opening the pump, piston 14 precedes the pump piston 15.

During the partial stroke 34, or at the latest, during the partial stroke 35, the air pump 6 starts to deliver compressed air substantially directly into the nozzle channel of the discharge opening 9, and said delivery only ends at the end of the partial stroke 37, because the air compressed in the pump chamber 51 of the air pump 6 by the actuating means continues to flow after the end of actuation until reaching a pressure limit. The pump chamber 51 is bounded by a pump piston 48 arranged in substantially fixed manner with a snap connection on the body 2, as well as a pump cylinder 49, which is formed by the jacket of the actuating head 8. The pump piston 48 is traversed by the outlet channel 11 or the actuating tappet 47. In the outlet of the pump chamber 51 facing the pump piston 48 is provided a discharge valve 50 operating in pressure-dependent manner and which opens after a first partial stroke and prior to reaching the partial stroke 36.

Substantially all the parts of the discharge apparatus can be plugged in and assembled from one side of the body 2, namely the open side of the cylinder casing 12. As the pump pistons 14, 15 have substantially planar end walls 42. 43 and the valve seat 45 is approximately located in the plane of the inside of the end wall 43, very compact dimensions are also obtained for the piston unit 13. In the jacket region, the pump pistons 14, 15 have substantially only cylindrical outer and/or inner shapes. The pump piston 48 is fixed with a snap connection and forms a closure for the rear assembly opening of the cylinder casing 12.

The discharge apparatus can also have in simple manner behind the sealing lip 22 in the starting position a ventilating means 52 supplied by the air pump chamber 51 for the storage vessel, which is tightly closed, at least in the starting position, by a ventilating valve 53. For this purpose the end wall 43 of the pump piston 15 forms on its outside a one-piece, conical valve body, which is pressed against a valve seat under the tension of the spring 32 and the closing force is substantially only transferred via the engaging parts of the delivery valve 40. Appropriately the valve seat is formed by a packing 54 of the pump piston 48 engaging in the rear, widened end of the cylinder casing 12 and traversed by the actuating tappet 47, so that it can be made from a relatively soft material. The annular ventilating channel leads from the pump chamber 51 between the packing 54 and the actuating tappet 47 to the ventilating valve 53 and from there, adjacent to the pump piston 15 and at right angles through the jacket of the cylinder casing 12 into an annular clearance, which is formed between the outer circumference of the rear end of the cylinder casing 12 and the inner circumference of a flange socket 55 of the body 2 surrounding the same with a radial spacing. On said flange socket 55 is mounted in stop-limited manner a cap 56, e.g. a screw and/or plug cap for fixing the discharge apparatus 1 to the bottle neck or similar reservoir. The latter can also be flexibly connected to the discharge apparatus.

By means of the ventilating valve 53, the storage chamber of the vessel can be placed under pressure with the air pump 6, so that at the start of the return stroke of the medium pump 5, the stored medium can be forced through the channel 18 into the pump chamber 39 or at least the suction of the medium is assisted. During the pump strike there is, through the control means 10, a pressure build up approximating in steplike manner to the outlet pressure of the delivery valve 40, so that at the start of the partial stroke 36 the delivery valve 40 is very rapidly opened.

I claim:

1. A dispenser for discharging at least one medium, the dispenser having an outlet (9) for release of the medium, the dispenser comprising:

a body (2);

at least one medium discharge unit (3) connected to said body (2), said discharge unit (3) being operable by an actuator (7) to perform a uni-directional stroke motion over a stroke path from a stroke beginning to a stroke end for dischargingly conveying a first discharge stream of a first one of said at least one medium at a standard quantity level, said uni-directional stroke motion including first, second and third partial strokes (34, 36, 37); and control means (10) for at least twice reducing the first discharge stream substantially below said standard quantity level over said first and third partial strokes (34, 37) of said uni-directional stroke motion as a path dependent function of said uni-directional stroke motion, said second partial stroke (36) being provided between said first and third partial stroke (34, 37) said control means 10 supplying the first discharge stream at said standard quantity level over said second partial stroke (36).

2. The dispenser according to claim 1, wherein said discharge unit is a medium pump having a pump chamber.

3. The dispenser according to claim 1, wherein said discharge stream substantially below said standard quantity level is at a zero quantity level.

4. The dispenser according to claim 2, wherein said control means provides a pressure relief in said pump chamber over at least one part of the stroke path, said control means returning a portion of said medium out of said pump chamber to a source of the medium.

5. The dispenser according to claim 2, wherein said control means includes at least one control valve, said control valve being a slide valve at least twice creating an open condition and at least once creating a closed condition of said pump chamber relative to a source of said at least one medium over said unidirectional stroke motion.

6. The dispenser according to claim 5, wherein said control valve provides an inlet valve for said pump chamber.

7. The dispenser according to claim 5, wherein said control valve defines a piston running path and wherein a piston sealing lip provided by a piston unit of said discharge unit displaceably cooperates with said piston running path for opening and closing said control valve.

8. The dispenser according to claim 5, wherein said control valve defines a valve seat substantially fixed relative to said body, said valve seat being a jacket surface on a collar, said control valve having a sealing lip engaging said jacket surface only in the closed position.

9. The dispenser according to claim 2, wherein said control means includes a collar having a valve seat fixed relative said body, said valve seat being a jacket surface on said collar, said control means having a sealing lip engaging said jacket surface only in a closed position and wherein said control valve provides a channel extending within said collar and leading to said pump chamber, said channel providing a supply channel for said pump chamber.

10. The dispenser according to claim 2, wherein said control means provides an increase of pressure in said pump chamber, wherein over a first part of said stroke path, said increase of pressure is gradual, and wherein over a separate second part of said stroke path, said increase of pressure is a substantially stepped increase.

11. The dispenser according to claim 2, wherein said control means provides a pressure relief in said pump chamber over said first and third partial strokes, said relief being abrupt.

12. A dispenser for discharging at least one medium, the dispenser having an outlet 9, the dispenser comprising:

a body 2;

at least one medium discharge unit 3 connected to said body 2, said discharge 3 unit being operable by an actuator 7 over a stroke path between a stroke beginning and a stroke end via an actuating stroke for dischargingly conveying a discharge stream of said at least one medium at a standard quantity level; and control means for at least twice supplying said discharge stream substantially below said standard quantity level as a function of the stroke path between the stroke beginning and the stroke end, wherein said discharge unit is a medium pump having a pump chamber, wherein said control means includes at least one control valve, said control valve being a slide valve at least twice creating an open condition and at least once creating a closed condition of said pump chamber relative to a source of said at least one medium during the stroke path, wherein said control valve has a valve seat defining first and second seat ends of a control face inclined from said first seat end, said second seat end of said control face connecting to a stepped shoulder.

13. The dispenser according to claim 2, wherein said pump chamber is at least partly annular and is defined by a radially inner convex circumference and a radially outer concave circumference, said inner circumference being provided by an outer surface of a sleeve of said control means defining an inlet and return channel for said pump chamber, said outer surface being a stepped surface, said control means including a control valve having a valve seat on said sleeve outer surface and a valve closing lip formed on a first piston provided in said pump chamber and moved by said actuator, a second piston unit having a piston lip, said radially outer circumference forming a piston running path for said piston lip, said valve closing lip and said piston lip being substantially coaxial in an axial direction corresponding to a direction of discharge flow in said pump chamber, said piston lip moving in the path of said valve closing lip during actuation.

14. A dispenser for discharging at least one medium, the dispenser having an outlet 9 for releasing the medium, the dispenser comprising:

a body 2;

at least one medium discharge unit connected to said body, said discharge unit being operable by an actuator over a stroke path between a stroke beginning and a stroke end via an actuating stroke for dischargingly conveying a discharge stream of said at least one medium at a standard quantity level; and control means for at least twice supplying said discharge stream substantially below said standard quantity level as a function of the stroke path between the stroke beginning and the stroke end, wherein said control means includes a control member separate from and supportingly connected to said body, said control member being a one-part component fixed as a plug-in connection to said body which provides a cylinder jacket, said control member being a sleeve-shaped socket having an outer circumference and freely projecting into said cylinder jacket of said body, said outer circumference providing a widened control collar.

15. A dispenser for media discharging at least one medium, the dispenser having an outlet 9 for release of the medium, the dispenser comprising:

a body;

at least one medium discharge unit connected to said body, said discharge unit being operable by an actuator over a stroke path between a stroke beginning and a stroke end via an actuating stroke for dischargingly conveying a discharge stream of said at least one medium at a standard quantity level; and control means for at least twice supplying said discharge stream substantially below said standard quantity level as a function of the stroke path between the stroke beginning and the stroke end;

wherein said discharge unit is a medium pump having a pump chamber and said control means provide the throttle for a flow of the medium in and out of said pump chamber and for a stepwise increase of a pressure in said pump chamber, said throttle defining a passage width, said passage width being bounded by an inclined face and being variable during the stroke path.

16. A dispenser for discharging at least one medium, the dispenser having an outlet for release of the medium, the dispenser comprising:

a body;

at least one medium discharge unit connected to said body, said discharge unit being operable by an actuator over a stroke path between a stroke beginning and a stroke end via an actuating stroke for dischargingly conveying a discharge stream of said at least one medium at a standard quantity level; and control means for at least twice supplying said discharge stream substantially below said standard quantity level as a function of the stroke path between the stroke beginning and the stroke end, wherein said discharge unit is a medium pump having a pump chamber, wherein said control means provides a throttle for a flow of the medium in and out of said pump chamber and for a stepwise increase of a pressure in said pump chamber, said throttle defining a passage width variable during the stroke path, wherein said throttle is provided by mutually displaceable members of said control means bounding an annular passage gap for the medium, said gap defining said passage width.

17. The dispenser according to claim 2, wherein said pump chamber is connected to an outlet channel leading to said outlet, said dispenser including a pressure dependently operating outlet valve for controlling flow between the pump chamber and said outlet channel.

18. The dispenser according to claim 17, wherein a piston unit having mutually displaceable pistons is provided in said pump chamber, said pistons providing inner and outer sealing lips, said pistons being displaceable with respect to each other against a spring force of a return spring in said medium pump, said outlet valve having valve members provided by said pistons of said piston unit.

19. The dispenser according to claim 17, wherein said control means controls the closing of said outlet valve during the stroke path, said outlet valve being substantially exclusively opened in a closed condition of a control valve of said pump chamber.

20. The dispenser according to claim 18, wherein said pistons define an outer piston and an inner piston extending inside said outer piston, said outer piston being cup-shaped and having an end wall, said outlet valve being located substantially on said end wall.

21. A dispenser for discharging at least one medium, the dispenser having an outlet for release of the medium, the dispenser comprising:

a body;

at least one medium discharge unit connected to said body, said discharge unit being operable by an actuator over a stroke path between a stroke beginning and a stroke end via an actuating stroke for dischargingly conveying a discharge stream of said at least one medium at a standard quantity level; and control means for at least twice supplying said discharge stream substantially below said standard quantity level as a function of the stroke path between the stroke beginning and the stroke end, wherein said discharge unit is a medium pump having a pump chamber, wherein said pump chamber is connected to an outlet channel leading to said outlet, said dispenser including a pressure dependently operating outlet valve for controlling flow between the pump chamber and said outlet channel, wherein a piston unit having mutually displaceable pistons is provided in said pump chamber, said pistons providing inner and outer sealing lips, said pistons being displaceable with respect to each other against a spring force of a return spring in said medium pump, said outlet valve having valve members provided by said pistons of said piston unit, wherein said pistons define a outer piston and an inner piston extending inside said outer piston, said outer piston being cup-shaped and having a end wall, said outlet valve being located substantially on said end wall, wherein said outer piston has a substantially cylindrical piston jacket having an open end and said inner piston has an outer circumference providing a ring shoulder, said open end of said outer piston jacket extending substantially up to said ring shoulder, said ring shoulder being provided between a section of said inner piston inside said outer piston and a section of said inner piston outside of said outer piston open end.

22. The dispenser according to claim 1, wherein discharge means are provided for separately conveying a second medium to the outlet for combination with said discharge stream.

23. The dispenser according to claim 22, wherein said discharge means supplies the second medium during a discharge phase, said discharge phase having a pressure dependent discharge start and a discharge end, said control means producing a pump thrust of said at least one medium delivered from said discharge unit, said pump thrust starting after said discharge start and ending prior to said discharge end of said discharge means.

24. The dispenser according to claim 22, wherein said discharge means includes an air pump operable by said actuator, said air pump being located substantially coaxially with a medium pump of said discharge unit, an outlet of said air pump being connected via an air outlet valve to an outlet channel of said medium pump, said outlet channel issuing into said outlet.

25. The dispenser according to claim 24, wherein said air pump includes a pump chamber, said air pump being controlled as a function of a pressure in said pump chamber, said outlet valve being an over pressure valve adjusted to open at the latest with a beginning of discharge of said at least one medium by said discharge unit.

26. The dispenser according to claim 1, wherein a storage vessel is provided for supplying said dispenser with medium, a venting means being provided for said storage vessel.

27. A dispenser for discharging at least one medium, the dispenser having an outlet for release of the medium, the dispenser comprising:

a body;

at least one medium discharge unit connected to said body, said discharge unit being operable by an actuator over a stroke path between a stroke beginning and a stroke end via an actuating stroke for dischargingly conveying a discharge stream of said at least one medium at a standard quantity level; and control means for at least twice supplying said discharge stream substantially below said standard quantity level as a function of the stroke path between the stroke beginning and the stroke end, wherein discharge means are provided for separately conveying a second medium to the outlet for combination with said discharge stream, wherein said dispenser includes an air pump operable by said actuator, said air pump being located substantially coaxially with a medium pump of said discharge unit, an outlet of said air pump being connected via an air outlet valve to an outlet channel of said medium pump, said outlet channel issuing into said outlet, wherein said air pump includes a pump chamber, wherein a storage vessel is provided for supplying said dispenser with the at least one medium, a venting means being provided for said storage vessel and, wherein said venting means provides a venting valve, said venting means being connected via said venting valve to said pump chamber of said discharge means.

28. A dispenser for discharging media, said dispenser having an outlet for the release of the media, the dispenser comprising:

a body;

at least one medium discharge unit connected to said body, said discharge unit being operable by an actuator over a stroke path between a stroke beginning and a stroke end via actuation stroke for dischargingly conveying a discharge stream of at least one medium of said media to the outlet; and at least one delivery means for supplying at least one further medium of the media to the outlet to mix with said discharge stream, wherein control means are provided for supplying a first quantity level of said discharge stream followed by a next higher quantity level of said discharge stream further followed by a further lower quantity level of said discharge stream that is lower than said next higher quantity level, said control means providing said first quantity level, said next higher quantity level and said further lower quantity level between the stroke beginning and the stroke end.

* * * * *

UNITED STATES PATENT AND TRADEMARK OFFICE

CERTIFICATE OF CORRECTION

PATENT NO. : 5,443,185
DATED : August 22, 1995
INVENTOR(S) : Karl H. Fuchs

It is certified that error appears in the above-indentified patent and that said Letters Patent is hereby corrected as shown below:

Col. 4, line 52 "bounced" should be --bounded--.

Col. 5, line 59 "constructed" should be --constricted--.

Signed and Sealed this

Ninth Day of January, 1996

*Attest:*

*Attesting Officer*

BRUCE LEHMAN

*Commissioner of Patents and Trademarks*